US005133484A

United States Patent [19]

Globert et al.

[11] Patent Number: 5,133,484

[45] Date of Patent: Jul. 28, 1992

[54] SUCTION TUBE DEVICE

[75] Inventors: Wolfgang Globert; Frank Meyer; Klaus-Dieter Neumann; Herbert Richter; Richard Wölkert, all of Berlin, Fed. Rep. of Germany

[73] Assignee: Schering Aktiengesellschaft, Berlin and Bergkamen, Fed. Rep. of Germany

[21] Appl. No.: 669,085

[22] Filed: Mar. 15, 1991

[51] Int. Cl.[5] ..... B67D 5/40; B67D 5/60

[52] U.S. Cl. ..... 222/376; 222/382; 222/464; 137/590

[58] Field of Search ..... 222/204, 372, 376, 377, 222/382, 416, 464, 481, 481.5, 482, 488; 137/123, 124, 126, 128, 142, 143, 147, 151, 577, 590, 592

[56] References Cited

U.S. PATENT DOCUMENTS

| | | | |
|---|---|---|---|
| 1,287,046 | 12/1918 | Knapp | 222/416 |
| 2,184,025 | 12/1939 | Smith et al. | 137/128 |
| 2,983,311 | 5/1961 | Anders | 137/590 X |
| 3,234,880 | 2/1966 | Hampton | 222/464 X |
| 3,390,698 | 7/1968 | Carmichael et al. | 137/590 X |
| 4,114,783 | 9/1978 | Wempe et al. | 222/464 X |
| 4,124,035 | 11/1978 | Rice | 137/126 X |
| 4,548,344 | 10/1985 | Hestehave et al. | 222/464 |
| 4,630,759 | 12/1986 | Dawn | 222/464 X |
| 4,865,232 | 9/1989 | Cassady, Jr. et al. | 222/464 |

FOREIGN PATENT DOCUMENTS

| | | | |
|---|---|---|---|
| 496204 | 7/1954 | Italy | 222/204 |

*Primary Examiner*—Kevin P. Shaver
*Attorney, Agent, or Firm*—Millen, White & Zelano

[57] ABSTRACT

A liquid siphon for emptying containers such as drums includes a main suction pipe, of a relatively large diameter, and an auxiliary suction pipe, of a relatively small diameter, which auxiliary suction pipe is coextensive with the main suction pipe and extends slightly beyond the main suction pipe. At the location where the siphon is attached to a hose, a stopcock is provided which is used to close the main suction pipe when the siphon begins to draw air so that the auxiliary suction pipe along pulls liquid from the container. In this way residual liquid is removed from the container.

16 Claims, 5 Drawing Sheets

SUCTION TUBE DEVICE

BACKGROUND OF THE INVENTION

The invention relates to a liquid siphon for emptying containers, especially drums, filled with liquid, with a suction pipe which can be inserted in the container wherein the upper end section of the siphon includes a connecting piece for connection to a pump.

Liquid siphons of the above-identified type generally have a VA suction pipe, which is lowered through the container opening into the container to the bottom of the container. The upper end of the suction pipe includes a connecting piece, for example, a threaded coupling, with which the suction pipe can be connected to a pump. The nominal diameter of the suction pipe is selected as large as possible, so that the liquid can be siphoned off from the container in a relatively short time. But the large pipe cross section has the drawback that the container can be emptied only to a residual amount of 1–2 liters. The reason for this lies in the fact that the pumps used must not siphon any air. The pump has to be turned off immediately as soon as air is sucked in with the liquid. These pumps generally have a monitor which turns off the pump at the right time. The amount of liquid contained in the suction pipe then runs back into the container. Another drawback of the known liquid siphons is that the residual amounts on the bottom of the container are frequently not picked up at all. The remainder of the container content, e.g., the solvent, remains in the container and is therefor never used.

Since shipping drums or shipping containers have to be cleaned, this residual amount is mixed with the washing water which must be disposed of at high expense to avoid damage to the environment by distillation or distillate combustion.

SUMMARY OF THE INVENTION

An object of this invention is therefore to provide a liquid siphon for emptying containers, with which almost the total container content can be siphoned off while maintaining the advantage of quick siphoning of the usual liquid siphon.

The residual amounts usually remaining in the containers can be siphoned off effectively if at least one additional suction pipe, whose cross section is smaller than the cross section of a main suction pipe, is placed parallel to the main suction pipe. When the pumping out process is almost completed, the suction pipe with the larger cross section is shut off by a stopcock, which is placed on the upper end section of the suction pipe. The residual amount is then pumped out by the additional suction pipe, with which a higher siphoning action is achieved because of the reduced cross section.

The siphoning efficiency of the usual siphon is maintained, since during the emptying process, the liquid is pumped out both by the suction pipe and by the additional suction pipe.

If a suction pipe for example with a 40 mm nominal diameter and an additional suction pipe with a 10 mm nominal diameter are used, the residual amount remaining in a drum can be reduced from 1–2 liters to 30–80 ml. The yield from the emptying is thus increased and the damage to the environment by, for example, solvent remaining in the container is markedly reduced.

The additional suction pipe can be placed either outside the suction pipe on its outer wall or inside the suction pipe, which is then especially advantageous if suction pipe, which is then especially advantageous if the size of the container opening is matched only to the usual siphon.

The additional suction pipe is placed according to an embodiment at least with its lower end section in the suction pipe and is led out in a sealed manner from the suction pipe before the stopcock. The additional suction pipe can be placed up to the upper end section of the suction pipe in the latter and can be led out from the latter only in the upper end section of the suction pipe. To bypass the stopcock placed in the upper end section of the suction pipe, the additional suction pipe merges into a bypass piece, which empties into the suction pipe behind the stopcock between the stopcock and the connecting piece.

Preferably, the bypass piece is led around the stopcock in spaced relation thereto so that it can additionally assume the function of a handle.

Picking up of the residual amount can thus be further improved in that the additional suction pipe with its lower end section projects from the lower end section of the suction pipe. In this case, the intake opening of the additional suction pipe is placed so that it faces the container bottom in the inserted state of the liquid siphon. This can be achieved by the lower end of the end section being bent toward the container bottom or also by inclining the end. Also, to be able to siphon off more residual liquid in the corners of the container, it has proved to be especially advantageous if the surface of the intake opening of the additional suction pipe forms an angle alpha of less than or equal to 90°, preferably 45°, with the longitudinal axis of its lower end section.

Depending on the type and shape of the container to be emptied, it is advantageous if the configuration of the liquid siphon is matched to the respective conditions. This is especially the case with iron-hooped drums, which are emptied in the horizontal state, where end section of the suction pipe are placed bent relative to the center part of the suction pipe. Preferred angles are about 45°. In this case, the longitudinal axes of the lower end section are aligned parallel to the longitudinal axis of the upper end section of the suction pipe. The alignment of the lower end section should be chosen so that the end section in the container to be emptied lies inclined at an angle which is preferably less than 15° so that the lower end section of the additional suction pipe lies on the container bottom.

The liquid siphon according to the invention is not only suitable for the emptying of iron-hooped drums but can also be used for the emptying of wine casks or, for example, oil tanks. Depending on the type of drums and the arrangement of the container opening, the shape and the configuration of the siphon is altered to be matched thereto. But in all cases, it is important that to a suction pipe with a large cross section, an additional suction pipe with a smaller cross section be provided, with which the residual amount usually remaining in the container can be pumped out except for negligibly small amounts. Especially in the chemical industry, where daily several hundred drums with chemicals (some of them extremely harmful to the environment) have to be emptied, the liquid siphon according to the invention contributes a noticeable lessening of pollution of the environment.

BRIEF DESCRIPTION OF THE DRAWINGS

Embodiments of the invention serving as examples are explained in more detail below by the drawings.

There are shown in.

DETAILED DESCRIPTION

Figure 1:
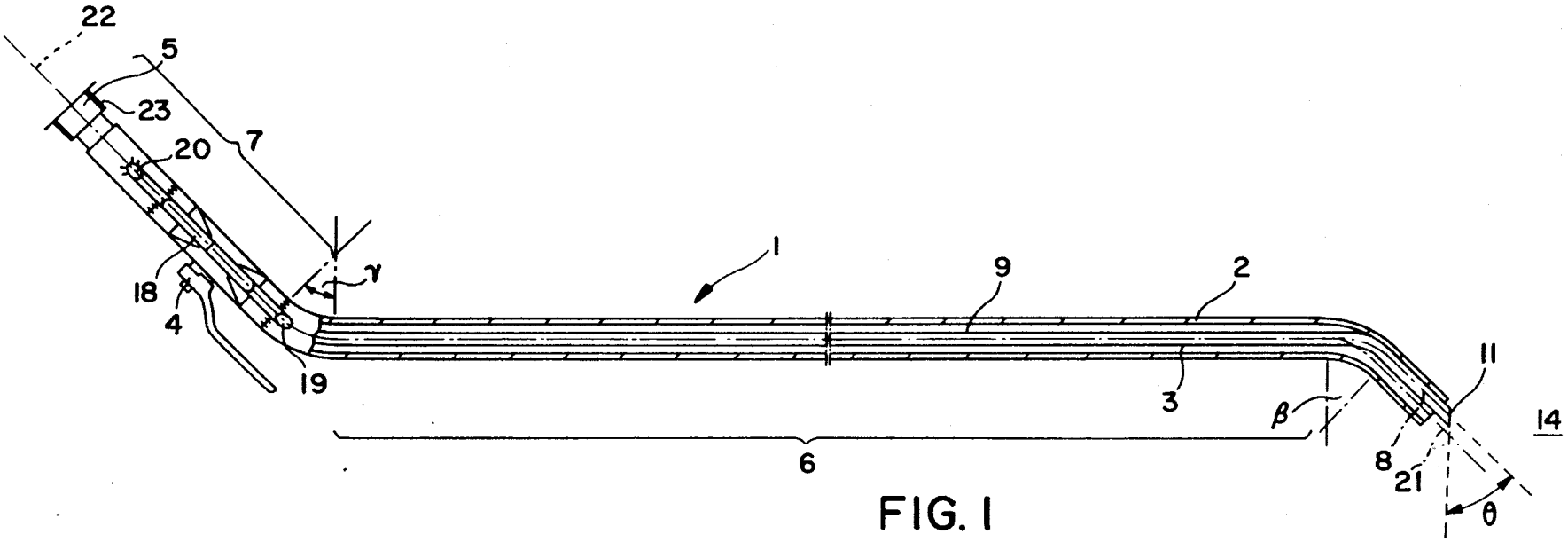
FIG. 1—the liquid siphon, partially in side view and partially in section.

In FIG. 1, the liquid siphon is represented partially in section, partially in side view. Throughout this specification, the term "liquid siphon" refers to a suction tube-type device, the terms "liquid siphon" and "suction tube-type device" meaning the same thing and being used interchangeably. Liquid siphon 1 includes a lower end section 5, a center part 6 and an upper end section 7. Lower end section 5 is oriented at an angle B of about 45° with respect to center part 6. Also, upper end section 7 is oriented at a bend relative to center part 6. Angle gamma, which indicates the orientation of upper end section 7 relative to center part 6, is also about 45° in the embodiment shown. Since lower end section 5, center part 6 and upper section 7 lie in a plane, respective longitudinal axes 21, 22 of lower end section 5 and upper end section 7 are aligned parallel to one another. The configuration of liquid siphon 1 shown in FIG. 1 is especially matched to the shape of iron-hooped drums, as is diagrammatically represented in FIG. 3.

Figure 2:
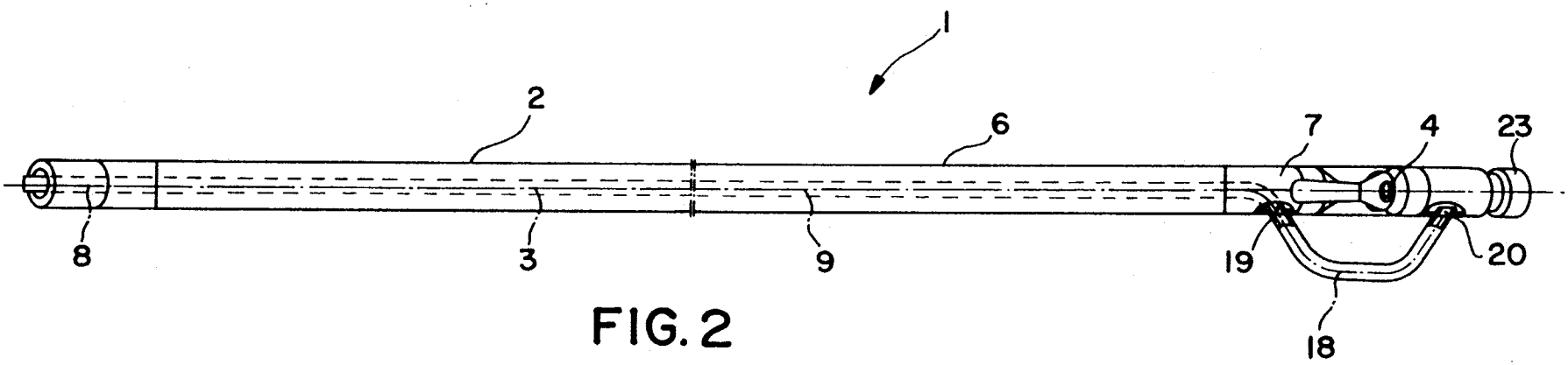
FIG. 2—the liquid siphon of FIG. 1 in top view with some elements shown in phantom.

An additional suction pipe 3 is placed in main suction pipe 2 which projects with its lower end section 8 from lower end section 5 of main suction pipe 2. The cross section of additional suction pipe 3 corresponds to about one fourth of the cross section of main suction pipe 2. The additional suction pipe 3 is led out at point 19 in upper end section 7 of suction pipe 2 from the latter and merges, as can be seen clearly in FIG. 2, into a bypass piece 10, which ends in suction pipe 2 at point 20. A stopcock 4, with which suction pipe 2 can be shut off, is placed between points 19 and 20. The liquid siphon is connected by a connecting piece 23 to a conventional suction pump 24 optionally interconnected to a hose 25 (see FIG. 3).

When emptying a container, stopcock 4 is first opened and the liquid is pumped out both by suction pipe 2 and by additional suction pipe 3. As soon as the container is almost emptied, and the first air is sucked in, which becomes apparent by a corresponding suction noise, stopcock 4 can be closed by the operator so that the liquid is subsequently pumped out exclusively by additional suction pipe 3. The residual liquid flowing back from suction pipe 2 into the container as well as the residual amounts still not picked up in this siphoning process are pumped out simply by additional suction pipe 3.

Figure 3:
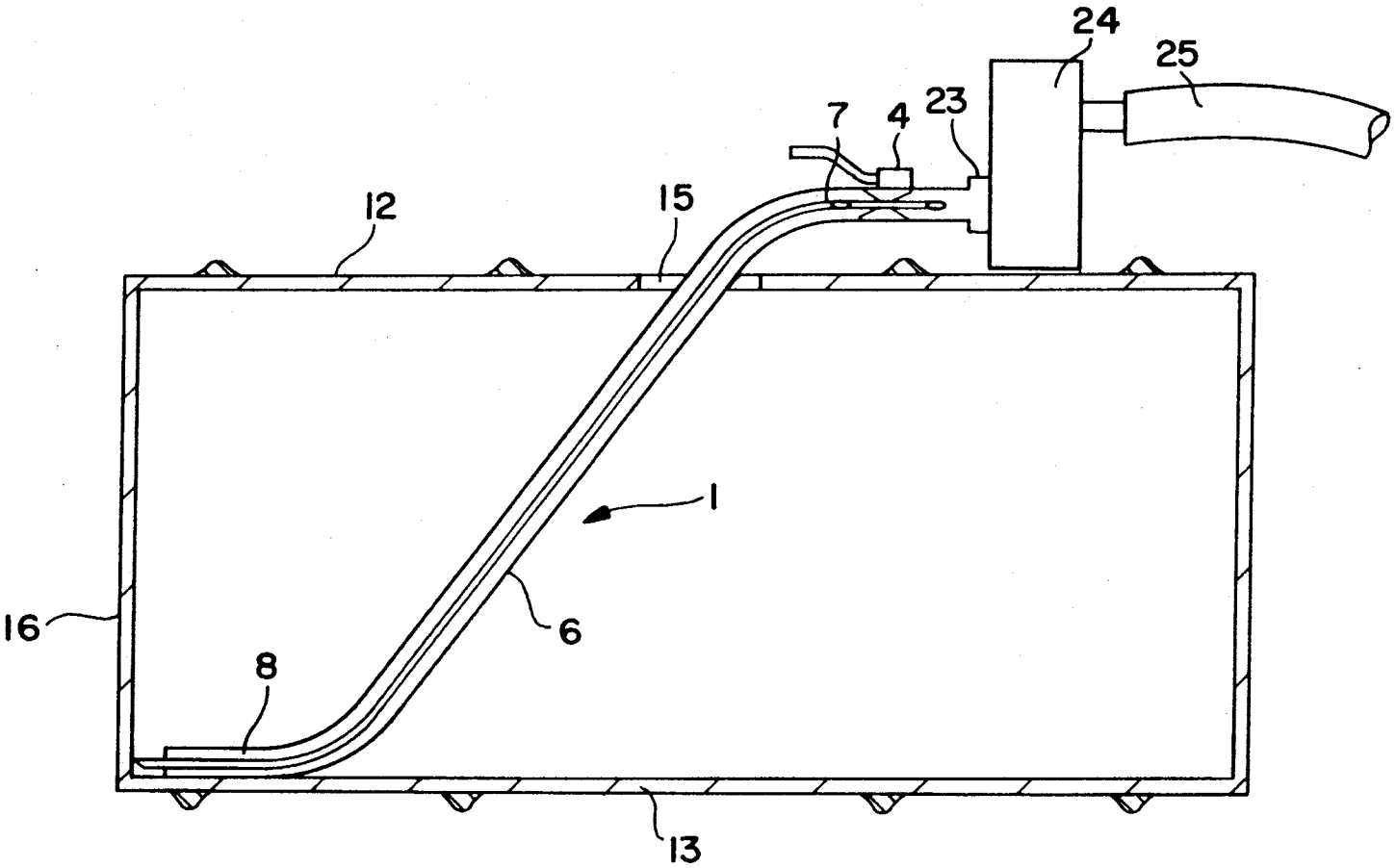
FIG. 3—the liquid siphon of FIG. 1 shown in a side view in a container to be emptied.

In FIG. 3, a container 12 is represented in the form of a horizontal iron-hooped drum. Liquid siphon 1 is inserted through opening 15. Because of the bent arrangement of upper end section 7 and lower end section 5 relative to center part 6, lower end section 5 lies on wall 13 of container 12, and the intake opening of liquid siphon 1 can be positioned in the corner of the container in the area of bottom wall 14.

Figure 4:
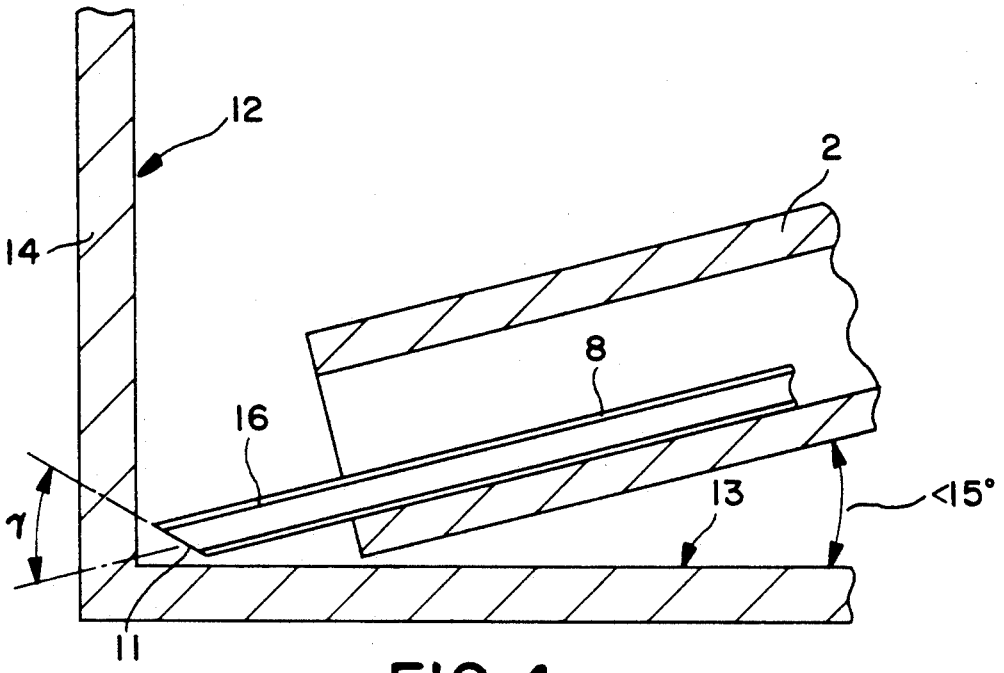
FIG. 4—an enlarged side view showing a detail X of FIG. 3.

The configuration of the intake opening of suction pipe 2 and especially that of intake opening 11 of additional suction pipe 3 is represented enlarged in FIG. 4. The lower end section of suction pipe 2 forms an angle of less than 15° with the wall and lies on container wall 13 in the area of the intake opening 11. Lower end section 8 of additional suction pipe 3 projects from suction pipe 2. End 16 of additional suction pipe 3 is inclined so that intake opening 11 is basically facing bottom wall 13 of container 12. The surface of intake opening 11 forms an angle gamma, which is about 45°, with longitudinal axis 17 of additional suction pipe 13 in the embodiment shown in FIG. 4. This embodiment is especially advantageous, if small residual amounts are still to be removed from the corners of container 12.

Figure 5:
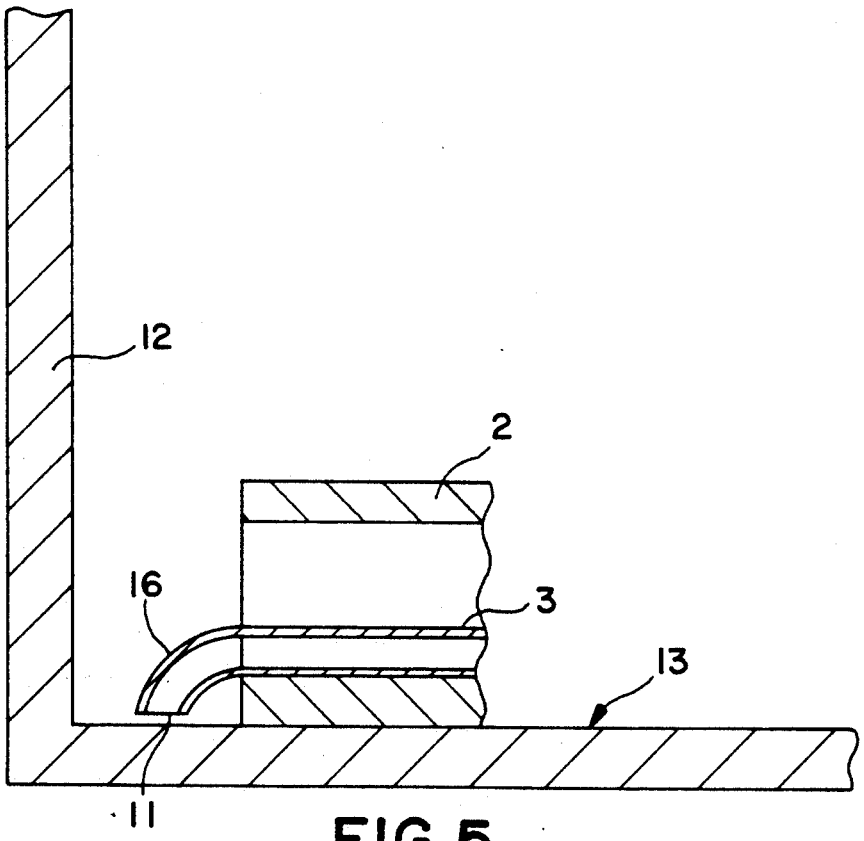
FIG. 5—an enlarged side view showing detail X of FIG. 3 according to another embodiment of the inventor.

Another configuration of end 16 of additional suction pipe 3 is represented in FIG. 5. Also in this embodiment, lower end section 8 of additional suction pipe 3 projects from suction pipe 2 and is bent in the direction of bottom wall 13 of container 12. In this case, intake opening 11 is placed directly over the surface of bottom wall 13 of container 12.

Figure 6:
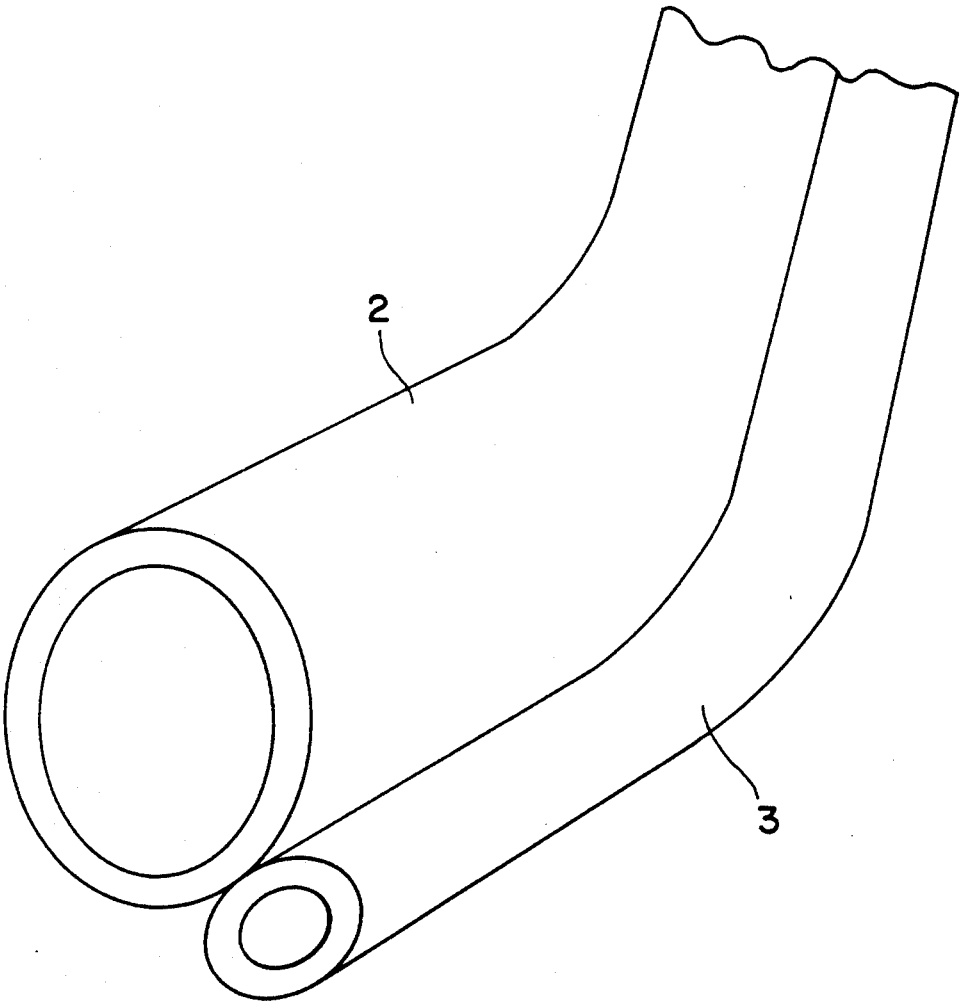
FIG. 6—an enlarged view of the lower end section, in perspective, of the liquid siphon according to another embodiment of the invention.

Another embodiment of liquid siphon 1 is represented in FIG. 6, in which additional suction pipe 3 is placed on the outer wall of suction pipe 2. This embodiment is suitable for the containers whose opening is suitably large so that the two suction pipes 2, 3, which are connected to one another, can be inserted in the container.

What is claimed is:

1. A suction tube device for emptying containers filled with liquid, the suction tube device having an upper end section which includes a connecting piece for connection to a pump, the suction tube device comprising:

a main suction pipe of a first cross section and at least one additional suction pipe having a cross section smaller than the cross section of the main suction pipe, the additional suction pipe being placed parallel to the main suction pipe; and a stopcock placed on the upper end section of the suction tube device, with the additional suction pipe terminating between the stopcock and the connecting piece in the main suction pipe, whereby upon closing the stopcock, the main suction pipe is closed and liquid is only drawn through the additional suction pipe.

2. The suction tube device according to claim 1, wherein the cross sectional area of the additional suction pipe is about one fourth of the cross sectional area of the main suction pipe.

3. The suction tube device according to claim 1, wherein the additional suction pipe has a lower end section positioned in the main suction pipe and emerges in a sealed manner from the main suction pipe in front of the stopcock.

4. The suction tube device according to claim 1, wherein the main suction pipe has an upper section and wherein the additional suction pipe emerges from the upper end section of the main suction pipe and merges into a bypass piece connected to the main suction pipe at a location between the stopcock and the connecting piece.

5. The suction tube device according to claim 4, wherein the bypass piece bypasses the stopcock in spaced relation thereto.

6. The suction tube device according to claim 3, wherein the additional suction pipe has a lower end section which projects from the lower end section of main suction pipe.

7. The suction tube device according to claim 1, wherein an intake opening of the additional suction pipe is placed so that in the inserted state of the liquid siphon, the intake opening faces the bottom of container.

8. The suction tube device according to claim 7, wherein the lower end of the additional suction pipe is inclined with respect to the axis of the additional suction pipe.

9. The suction tube device according to claim 8, wherein the surface of the intake opening of additional suction pipe forms an angle not greater than 90° with the longitudinal axis of the lower end section.

10. The suction tube device according to claim 1, wherein the upper end section and the lower end section of main suction pipe is oriented at an angle relative to its center part.

11. The suction tube device according to claim 10, wherein the longitudinal axis of the lower end section is aligned parallel to the longitudinal axis of the upper end section of the main suction pipe.

12. The suction tube device according to claim 1, wherein the main suction pipe and additional suction pipe are manufactured from VA steel.

13. A suction tube device for siphoning liquids, comprising:

a main suction pipe of a selected diameter having a first end into which liquid is drawn and a second end from which liquid is transferred;

an additional suction pipe of a diameter less than the selected diameter of the main suction pipe, the additional suction pipe being coextensive along a substantial portion of the main suction pipe and having a first end into which liquid is drawn and a second end from which liquid is transferred;

valve means connected to the second ends of both the main suction pipe and additional suction pipe, the valve means including means for selectively disconnecting the main suction pipe from the siphon while allowing the additional suction pipe to draw liquid whereby residual liquid is siphoned by the additional pipe upon disconnecting the main suction pipe to avoid air being entrained by the liquid being siphoned.

14. The suction tube device of claim 13, wherein the first end of the additional suction pipe extends beyond the first end of the main suction pipe.

15. The suction tube device of claim 14, wherein the additional suction pipe is within the main suction pipe.

16. The suction tube device of claim 14, wherein the suction pipes have a main portion extending along a main axis and wherein the first end of at least one of the suction pipes extends in an angle to the main axis to facilitate draining a corner of a container being siphoned.

* * * * *